US006652324B2

(12) United States Patent
Maiers et al.

(10) Patent No.: US 6,652,324 B2
(45) Date of Patent: Nov. 25, 2003

(54) SELF-BIASING SPINDLE MOTOR CONNECTOR

(75) Inventors: Michael Alan Maiers, Longmont, CO (US); Robert Terry Haas, Longmont, CO (US); Ryan Andrew Sievers, Longmont, CO (US)

(73) Assignee: Seagate Technology LLC, Scotts Valley, CA (US)

( * ) Notice: Subject to any disclaimer, the term of this patent is extended or adjusted under 35 U.S.C. 154(b) by 58 days.

(21) Appl. No.: 09/892,288

(22) Filed: Jun. 26, 2001

(65) Prior Publication Data

US 2002/0004334 A1 Jan. 10, 2002

Related U.S. Application Data

(60) Provisional application No. 60/217,041, filed on Jul. 10, 2000.

(51) Int. Cl.[7] ..... H01R 24/00

(52) U.S. Cl. ..... 439/660; 310/71; 439/926

(58) Field of Search ..... 360/97.01, 77.02, 360/400, 98.7, 78.04, 99.08, 99.11; 310/71, 91; 439/660, 77, 83, 926

(56) References Cited

U.S. PATENT DOCUMENTS 5,541,787 A * 7/1996 Jabbari et al. ..... 360/97.01
5,659,213 A * 8/1997 Imashiro et al. ..... 360/99.8
5,705,868 A * 1/1998 Cox et al. ..... 310/71
6,091,572 A * 7/2000 Cox ..... 360/99.08

* cited by examiner

*Primary Examiner*—P. Austin Bradley
*Assistant Examiner*—Briggitte R. Hammond
(74) *Attorney, Agent, or Firm*—Merchant & Gould, P.C.

(57) ABSTRACT

A self-biasing spindle motor connector (such as 200) for a disc drive (such as 100) is disclosed. The spindle motor connector (such as 200) includes a body portion (such as 202) and a plurality of alloy contacts (such as 204) extending away from the body portion. The connector may comprise a crush rib (such as 206) extending from at least one side of the body portion and making contact with a vertical wall (such as locating edge 208) of a base plate (such as 102) of the disc drive. The crush rib ensures that the connector is properly biased to a reference edge and situated in relation to the base plate and the disc drive printed circuit board. An x-y control boss (such as 212) prevents the connector from moving in the x-y directions while the crush rib prevents the connector from rotational movement. The connector may also include a rotational boss (such as 216) that is inserted into a rotational control hole of the base plate to prevent rotational movement of the connector.

17 Claims, 10 Drawing Sheets

SELF-BIASING SPINDLE MOTOR CONNECTOR

RELATED APPLICATIONS

This application claims priority of U.S. provisional application Serial No. 60/217,041, filed Jul. 10, 2000.

FIELD OF THE INVENTION

This application relates generally to a disc drive and more particularly to a self-biasing spindle motor connector.

BACKGROUND OF THE INVENTION

A spindle motor connector of a disc drive provides commutation power to a spindle motor. The spindle motor connector also senses the correct spin-up direction and provides back electromotive force (BEMF) sensing information to control the speed and direction of the spindle motor. The spindle motor connector controls these functions via a number of alloy contacts (on the connector) that connect to pads (on a printed circuit board). Spindle motor connectors are typically assembled into a disc drive by locating the spindle motor connector into a hole and against a surface of a base plate of the disc drive.

Depending on a given disc drive system's tolerance build-up, making the contact between the spindle motor contacts and the pads of the printed circuit board (PCB) may be problematic. For example, cast and machined features control the amount that the spindle motor connector moves in an x-y plane. However, movement in the x-y plane may contribute to the problem as may rotational movement which tends to be magnified. Rotational tolerance refers to the amount that the spindle motor connector is allowed to rotate due to its fit with mating features. The combined effect of rotational movement and movement in the x-y plane determines whether the connection between the contacts and the pads is reliably made.

Another problem in disc drives is that the contacts may be at some distance from the origin point that controls the movement of the spindle motor connector in the x-y plane. Thus, when the spindle motor connector rotates about the origin, the contact points that interface with the PCB pads swing through a large angle. At large angles this swinging may prevent the assembly from working as there must always be at least a certain minimum amount of overlap between the contacts and the pads on the PCB for the assembly to function. Moreover, the contacts, if misaligned, may connect with adjacent pads. Although the pads may be made larger to connect with the proper contacts, the pads may not be made excessively large because PCB space is limited.

A typical method to rotationally bias, i.e. control the rotation, of a spindle motor connector is to fix the connector in position with assembly tooling until an adhesive cures. Another method is to add precise locating features through additional machining, pressed-in place pins or other fixtures. However, these methods are time-consuming or require additional costly tooling and fixtures. There are also additional inspection costs due to the need to verify the accuracy of the tooling.

Accordingly, there is a need for a spindle motor connector that may be assembled into the base plate without the need for using a fixture. There is a further need for a spindle motor connector that enhances throughput capability while saving on the cost of fixturing or eliminating the need for such assembly tooling altogether. There is a further need for a spindle motor connector that is self-biasing and maintains its position. Thus, there is a need for a method for assembling a spindle motor connector that is self-biasing and does not require additional tooling and fixtures or additional costly machining.

The present invention provides a solution to this and other problems, and offers other advantages over the prior art.

SUMMARY OF THE INVENTION

Against this backdrop the present invention has been developed. In one embodiment, the present invention is a spindle motor connector that provides its own rotational bias without the need for a separate fixture. In one embodiment, the present invention enhances throughput capability and eliminates the fixtures and tooling found in the prior art, thereby saving costs. In one embodiment, the present invention also does not occupy valuable space on the PCB that may be needed for other components.

In one embodiment of the present invention, the invention comprises a self-biasing spindle motor connector for a disc drive. The spindle motor connector includes a body portion and a plurality of alloy contacts extending away from the body portion. The alloy contacts are used for connecting to pads on a disc drive printed circuit board. The connector may comprise a crush rib extending from at least one side of the body portion and making contact with a vertical wall (locating edge) of a base plate of the disc drive. The crush rib ensures that the connector is properly biased and situated in relation to the base plate and the disc drive printed circuit board. The body portion may also include an extending member to provide an alignment feature for the printed circuit board as it is assembled to the disc drive and helps align the PCB pads to the alloy contacts of the connector. The connector may also include an x-y control boss. The x-y control boss limits the connector's movement in an x-y plane whereas the crush rib restricts the connector's rotational movement. The x-y control boss mates with a corresponding hole (opening) in the base plate.

In yet another embodiment, the connector may also include a rotational control boss that is inserted into a rotational control hole (opening) of the base plate to limit rotational movement of the connector. The connector may also include support legs that prevent the alloy contacts from being damaged by the load from the PCB.

An embodiment of the present invention may be implemented as a method for assembling a disc drive by inserting a spindle motor connector into a base plate of the disc drive such that a rotational boss of the connector is inside a rotational control opening of the base plate and such that an x-y control boss of the connector is inside an x-y control opening of the base plate. The method may also include the step of inserting a disc drive printed circuit board (PCB) on the base plate such that a plurality of alloy contacts on the connector come into contact with a plurality of pads of the PCB.

These and various other features as well as advantages which characterize the present invention will be apparent from a reading of the following detailed description and a review of the associated drawings.

DETAILED DESCRIPTION

Figure 1:
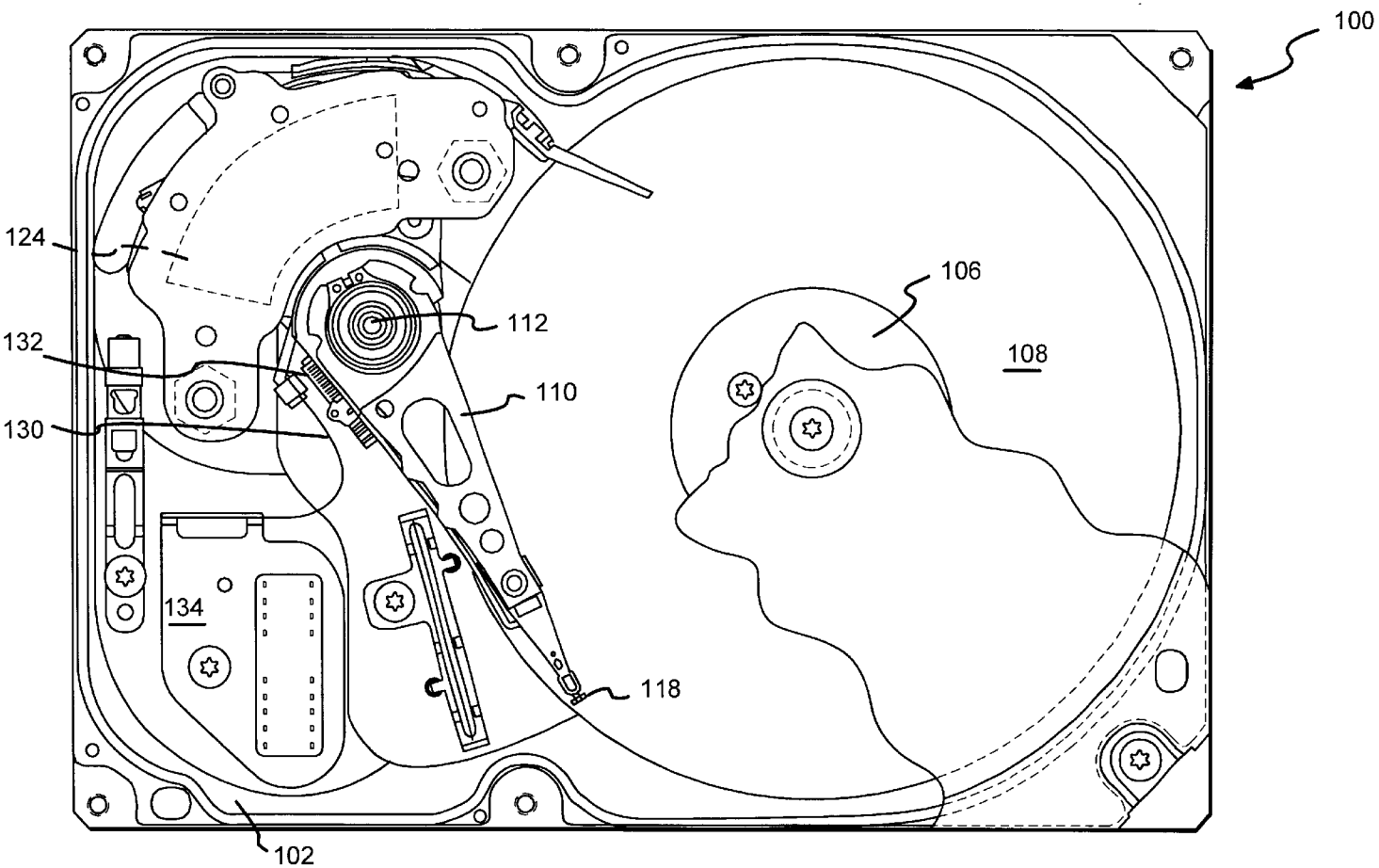
FIG. 1 is a plan view of a disc drive incorporating a preferred embodiment of the present invention showing the primary internal components.

A disc drive 100 constructed in accordance with a preferred embodiment of the present invention is shown in FIG. 1. The disc drive 100 includes a base plate 102 to which various components of the disc drive 100 are mounted. A top cover (not shown) cooperates with the base 102 to form an internal, sealed environment for the disc drive in a conventional manner. The components include a spindle motor 106 that rotates one or more discs 108 at a constant high speed about a hub. Information is written to and read from tracks on the discs 108 through the use of an actuator assembly 110, which rotates during a seek operation about a bearing shaft assembly 112 positioned adjacent the discs 108. The actuator assembly 110 may include a plurality of actuator arms which extend towards the discs 108, with one or more flexures extending from each of the actuator arms. Mounted at the distal end of the actuator assembly 110 are read/write heads 118.

During a seek operation, the track position of the heads 118 is controlled through the use of a voice coil motor (VCM) 124, which typically includes a coil attached to the actuator assembly 110, as well as one or more permanent magnets which establish a magnetic field in which the coil is immersed. The controlled application of current to the coil causes magnetic interaction between the permanent magnets and the coil so that the coil moves in accordance with the well-known Lorentz relationship. As the coil moves, the actuator assembly 110 pivots about the bearing shaft assembly 112, and the heads 118 are caused to move across the surfaces of the discs 108.

A flex assembly 130 provides the requisite electrical connection paths for the actuator assembly 110 while allowing pivotal movement of the actuator assembly 110 during operation. The flex assembly includes a printed circuit board 132 to which head wires (not shown) are connected; the head wires being routed along the actuator assembly 110 to the heads 118. The printed circuit board 132 typically includes circuitry for controlling the write currents applied to the heads 118 during a write operation and a preamplifier for amplifying read signals generated by the heads 118 during a read operation. The flex assembly terminates at a flex bracket 134 for communication through the base plate 102 to a disc drive printed circuit board (not shown) mounted to the bottom side of the disc drive 100.

Typically, the disc drive 100 is operably connected to a host computer in which the disc drive is mounted in a conventional manner. Control communication paths are provided between the host computer and a disc drive microprocessor, the microprocessor generally providing top level communication and control for the disc drive 100 in conjunction with programming for the microprocessor stored in microprocessor memory (MEM). The MEM can include random access memory (RAM), read only memory (ROM) and other sources of resident memory for the microprocessor.

The discs 108 are rotated at a constant high speed by a spindle control circuit, which typically electrically commutates the spindle motor 106 through the use of back electromotive force (BEMF) sensing. During a seek operation, the track position of the heads 118 is controlled through the application of current to the coil of the actuator assembly 110. A servo control circuit typically provides such control. During a seek operation the microprocessor receives information regarding the velocity and acceleration of the heads 118, and uses that information in conjunction with a model, stored in memory, to communicate with the servo control circuit, which will apply a controlled amount of current to the voice coil motor 124, thereby causing the actuator assembly 110 to be pivoted.

Data is transferred between the host computer and the disc drive 100 by way of a disc drive interface, which typically includes a buffer to facilitate high speed data transfer between the host computer and the disc drive 100. Data to be written to the disc drive 100 are thus passed from the host computer to the interface and then to a read/write channel, which encodes and serializes the data and provides the requisite write current signals to the heads 118. To retrieve data that has been previously stored by the disc drive 100, read signals are generated by the heads 118 and provided to the read/write channel, which performs decoding and error detection and correction operations and outputs the retrieved data to the interface for subsequent transfer to the host computer.

An embodiment of the present invention provides a novel self-biasing spindle motor connector. The spindle motor connector provides commutation power to the spindle motor 106. The spindle motor connector also senses the correct spin-up direction and provides information to control the speed of the spindle motor. The spindle motor connector attaches to the baseplate 102. Wires from the spindle motor feed through a hole in the connector (preventing them from shorting to the metal baseplate 102) and are terminated (soldered) to a plurality of contacts. The contacts provide electrical connection to the disc drive printed circuit board (not shown) mounted to the bottom side of the disc drive 100 in FIG. 1. Thus, the spindle motor connector is mounted to the bottom side of baseplate 102 shown in FIG. 1.

Figure 2:
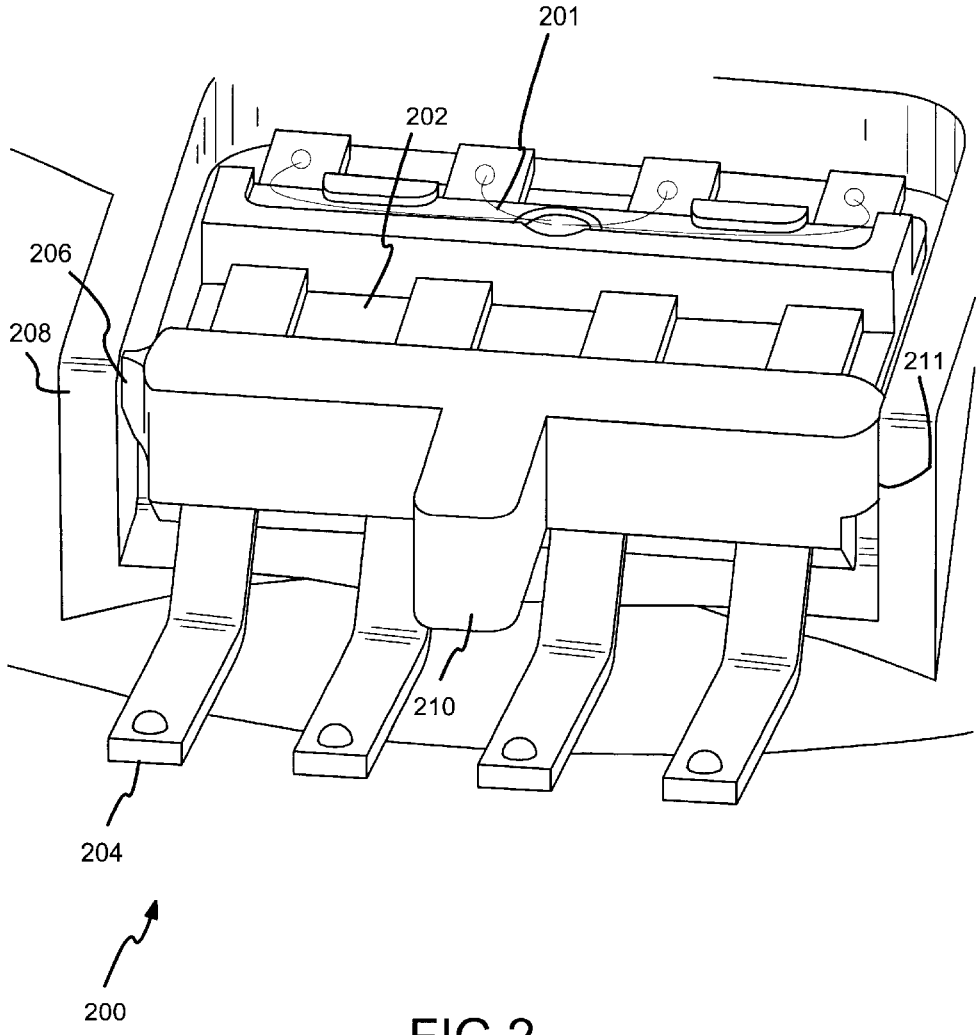
FIG. 2 is an illustration of a self-biasing spindle motor connector in accordance with an embodiment of the present invention.

Referring now to FIG. 2, an illustration of a self-biasing spindle motor connector 200 in accordance with an embodiment of the present invention will be described. The connector 200 comprises a body portion 202 and a plurality of alloy contacts 204 extending away from the body portion 202. The alloy contacts 204 are used for connecting to pads on the disc drive printed circuit board (not shown). Wires 201 from the spindle motor are terminated to the contacts 204.

The connector 200 also comprises a crush rib 206 extending from at least one side of the body portion 202 and making contact with a vertical wall (locating edge) 208 of the base plate 102. The crush rib 206 of the connector body 202 may also comprise a vertical lead-in which mates with the vertical wall 208 of the baseplate 102 to ensure that the connector is properly biased. The body portion also comprises an extending member 210. Extending member 210 provides an alignment feature for the disc drive printed circuit board as it is assembled to the disc drive and helps align the PCB pads to the alloy contacts of the connector.

The crush rib 206 ensures that the connector 200 is properly biased and situated in relation to the base plate and the disc drive printed circuit board. The crush rib 206 also prevents the spindle motor connector from rotating away from a reference edge 211 on the baseplate and maintains the correct alignment of the connector to the baseplate while an adhesive sets or cures the connector 200 in place. Thus, the crush rib acts as a biasing spring load to absorb tolerance and provide a tight intimate fit between the connector and the baseplate 102.

Figure 3:
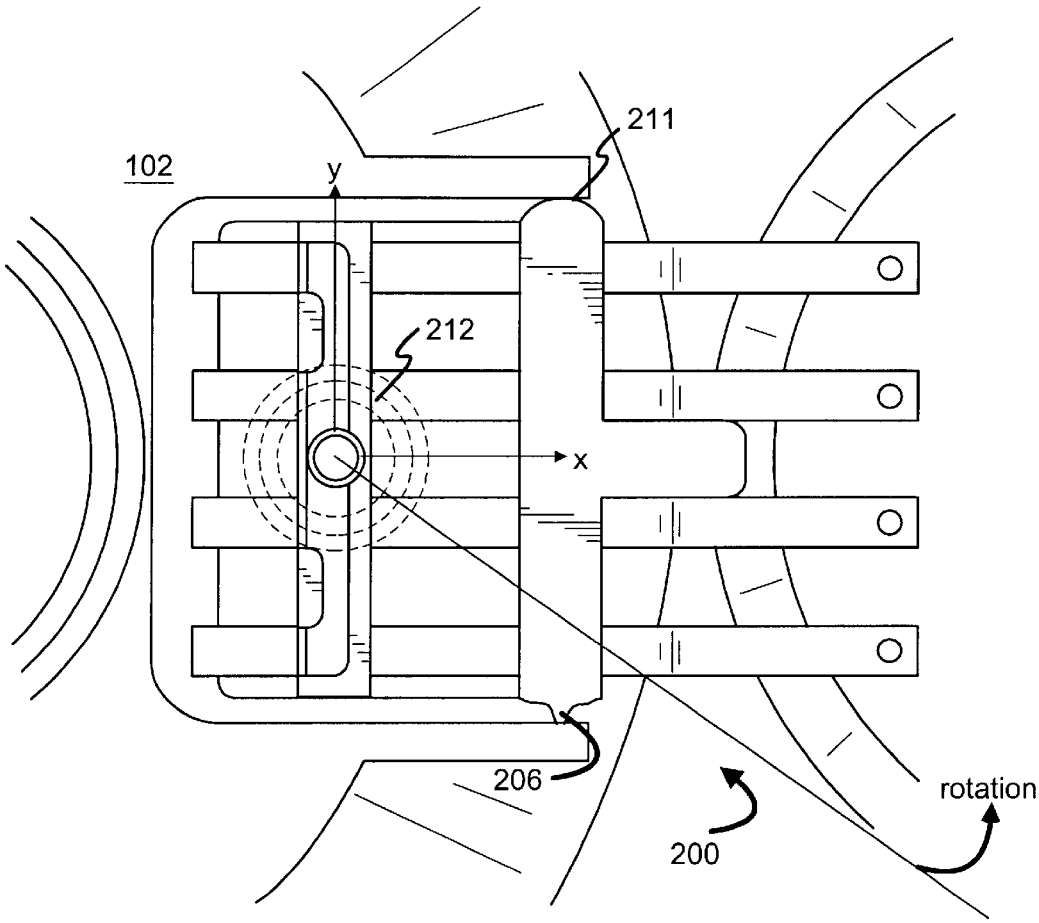
FIG. 3 is an illustration of a bottom view of a spindle motor connector in accordance with an embodiment of the present invention.

Referring now to FIG. 3, an illustration of a bottom view of a spindle motor connector 200 in accordance with an embodiment of the present invention will be described. As shown in FIG. 3, the connector 200 includes an x-y control boss 212. The x-y control boss prevents the connector 200 from moving in the x-y plane while the crush rib 206 prevents the connector from rotational movement. The x-y control boss mates with a hole, or opening, in the baseplate 102. Thus, the x-y control boss 212 and the crush rib 206 act on the connector to bias it against the reference edge 211 of the baseplate maintaining intimate contact while the adhesive sets or cures.

Figure 4:
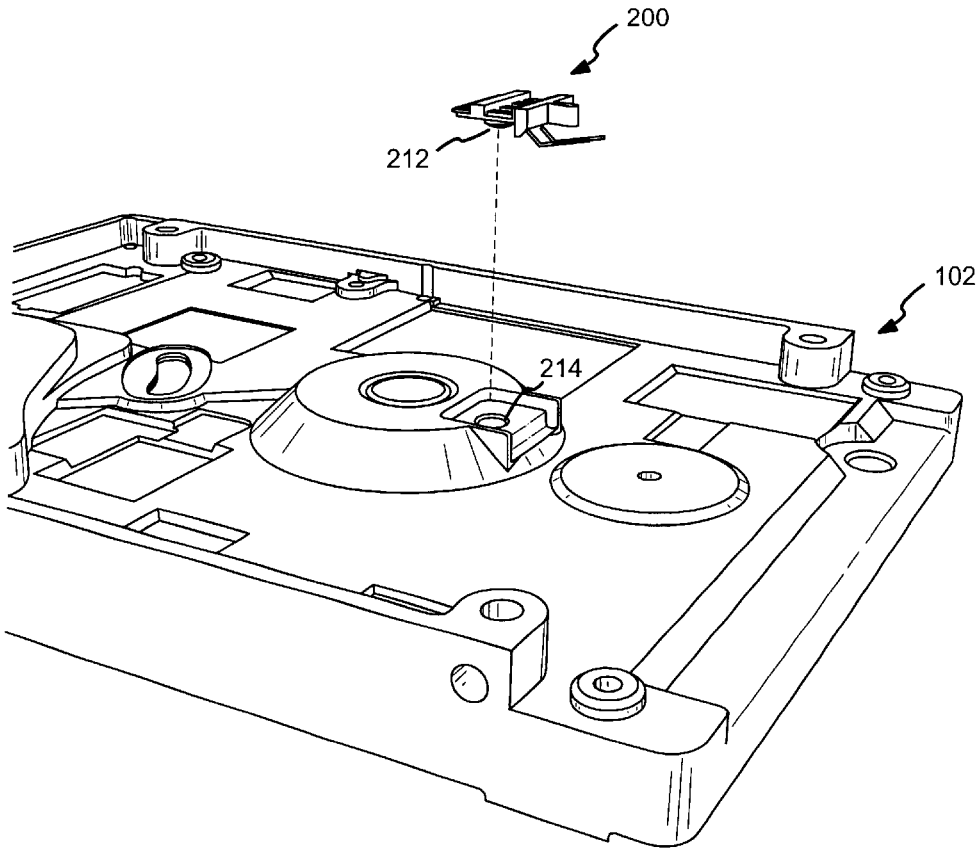
FIG. 4 is an illustration of a spindle motor connector in accordance with an embodiment of the present invention being installed into a base plate of a disc drive.

Referring now to FIG. 4, an illustration of a spindle motor connector 200 in accordance with an embodiment of the present invention being installed into a base plate will be described. As shown in FIG. 4, the spindle motor connector 200 includes an x-y control boss 212 that is inserted into an x-y control hole 214 of the base plate 102.

Figure 5:
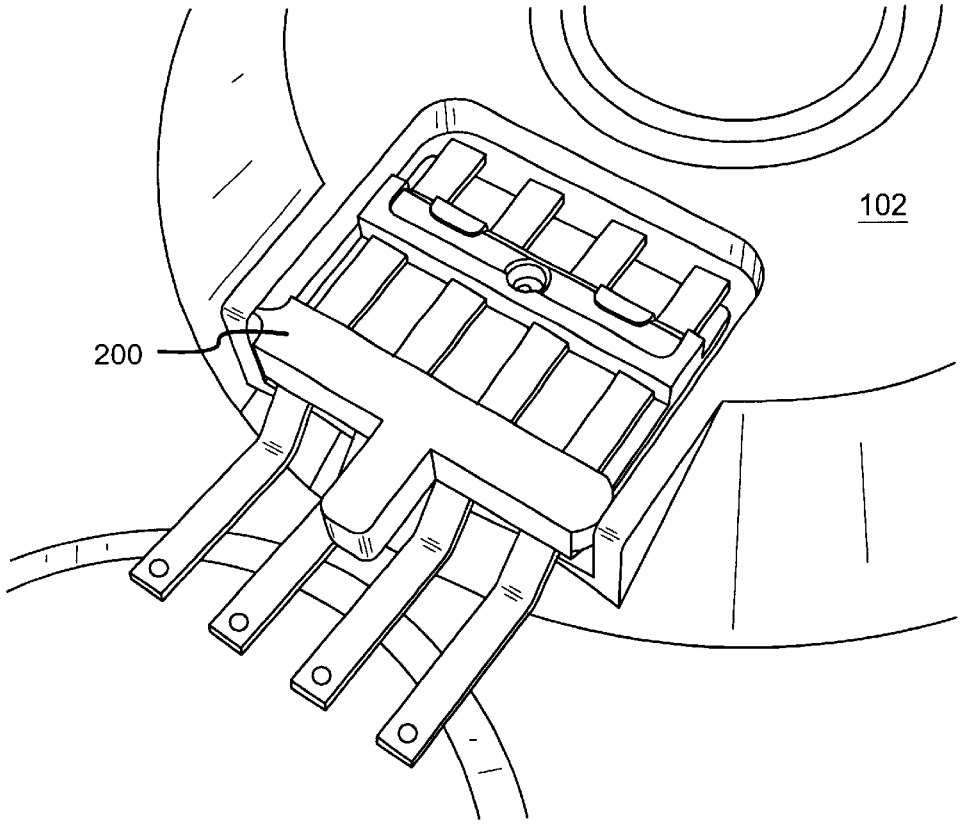
FIG. 5 is an illustration of a spindle motor connector in accordance with an embodiment of the present invention after installation into a base plate of a disc drive.

FIG. 5 is an illustration of a spindle motor connector 200 in accordance with an embodiment of the present invention after it is installed into a base plate 102. Although not shown in FIG. 5, those skilled in the art will understand that a disc drive printed circuit board is installed onto the base plate such that the alloy contacts are deflected to maintain contact with the disc drive PCB.

Figure 6:
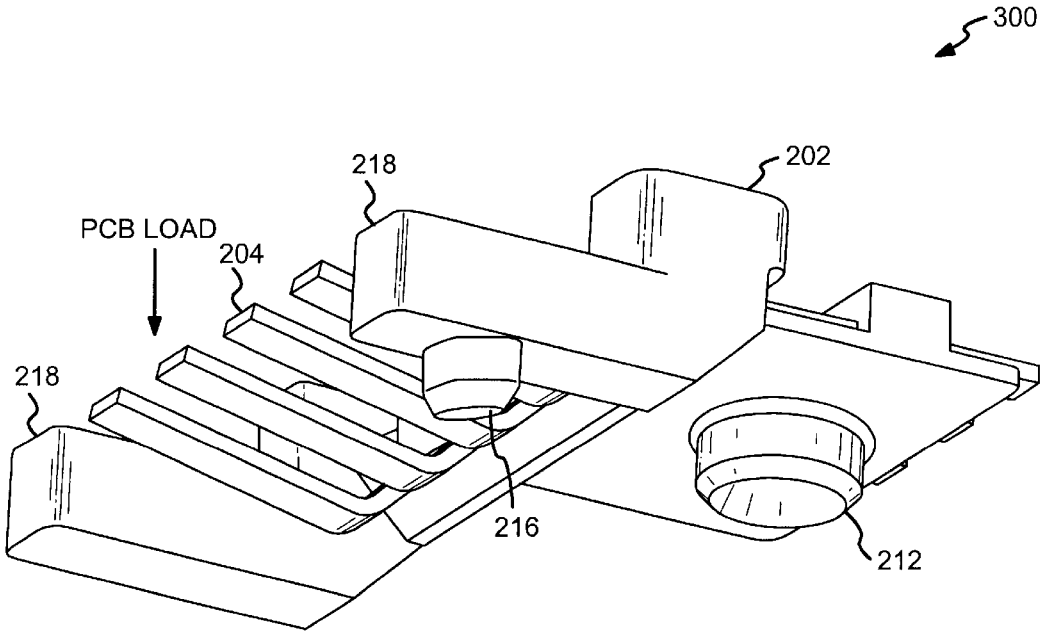
FIG. 6 is an illustration of a spindle motor connector in accordance with another embodiment of the present invention.

Referring now to FIG. 6, an illustration of a spindle motor connector 300 in accordance with another embodiment of the present invention will be described. The connector 300 comprises a body portion 202 and a plurality of alloy contacts 204. The connector 300 also comprises an x-y control boss 212 for preventing movement of the connector 300 in the x-y plane. The body portion 202 also comprises a plurality of support legs 218 that extend alongside the alloy contacts. The support legs 218 help to counter the forces generated by the disc drive PCB as it makes contact with the alloy contacts. In other words, the support legs 218 ensure that the alloy contacts are not damaged by the overtravel of the PCB load and limit the overtravel of the PCB. Extending from the bottom of at least one of the support legs 218 is a rotational boss 216 that restricts rotational movement of the connector 300 by mating with a rotational opening in the baseplate.

Figure 7:
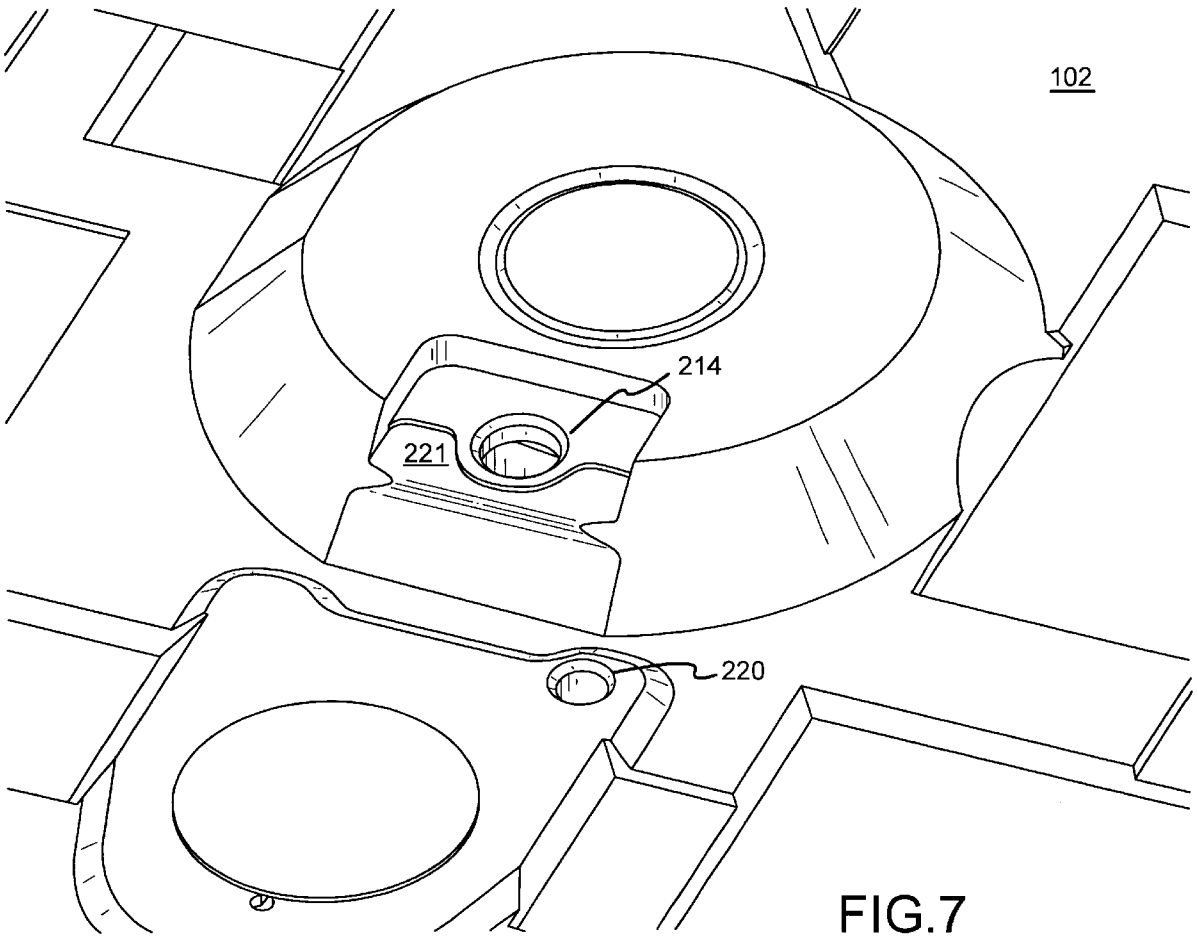
FIG. 7 is an illustration of a base plate of a disc drive for mating with a spindle motor connector in accordance with an embodiment of the present invention.

Referring now to FIG. 7, an illustration of a base plate 102 for mating with the spindle motor connector 300 in accordance with an embodiment of the present invention will be described. The base plate comprises an x-y control hole 214 for mating with the x-y control boss 212 and restricting movement of the connector in the x-y directions. The base plate further comprises a rotational control hole 220 for receiving the rotational boss 216 and restricting rotational movement of the connector. The baseplate 102 may comprise an adhesive zone 221 located adjacent to the x-y control hole 214. The adhesive zone 221 is an indentation in the baseplate for receiving adhesive used to bond the spindle motor connector to the baseplate.

Figure 8:
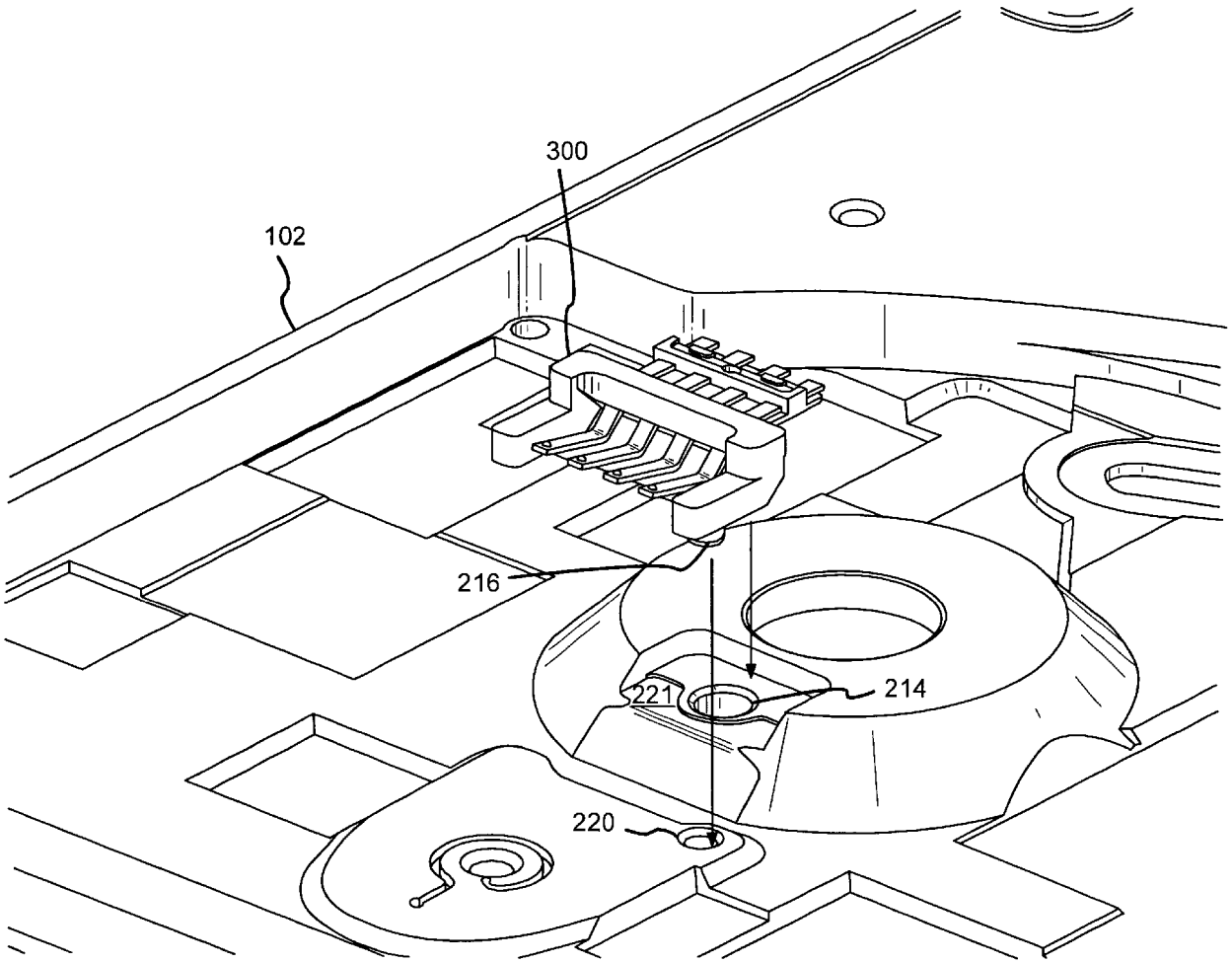
FIGS. 8 and 9 are illustrations of a spindle motor connector in accordance with an embodiment of the present invention being installed onto a base plate of a disc drive.
Figure 9:
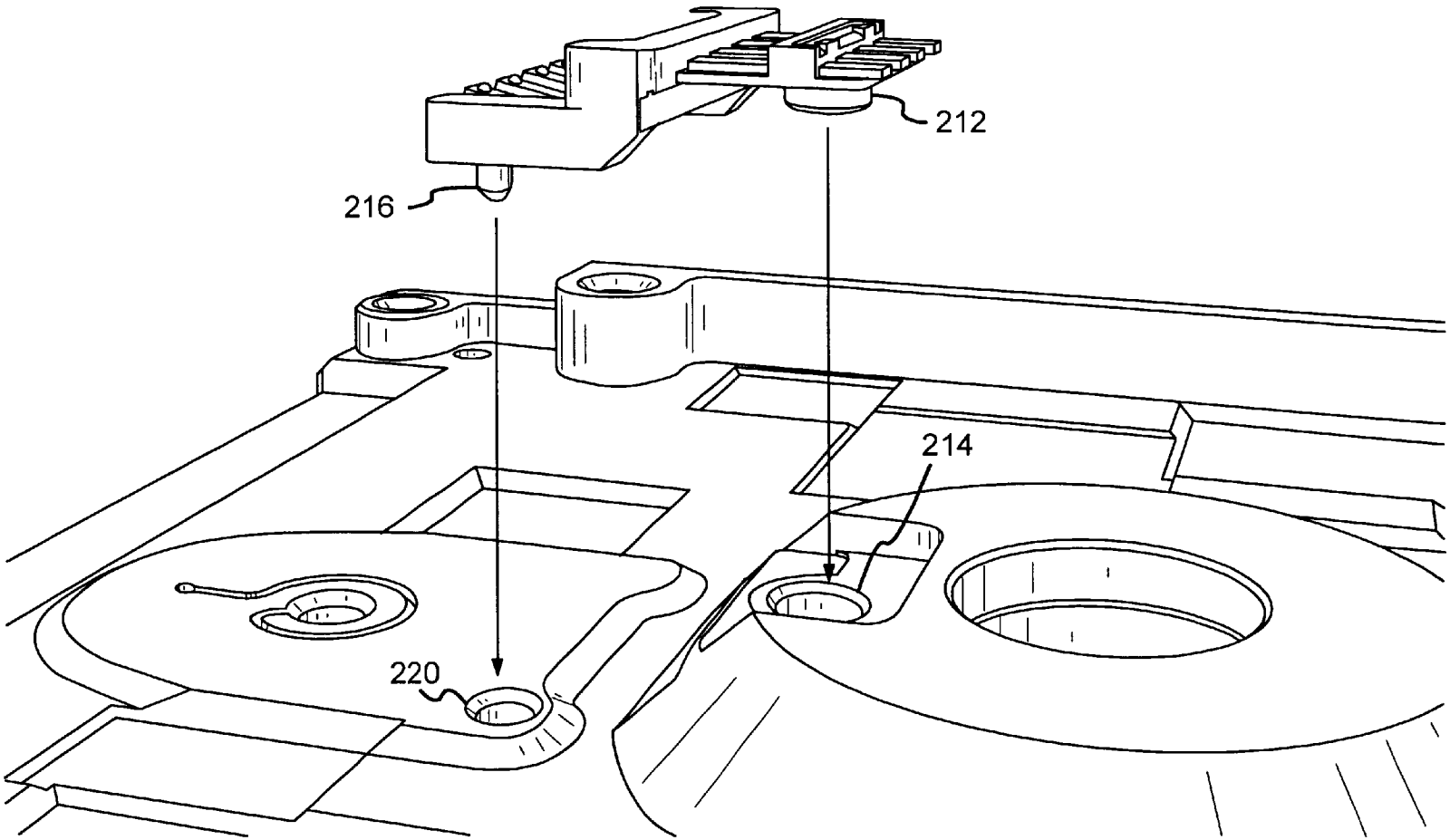

FIGS. 8 and 9 illustrate a spindle motor connector 300 in accordance with an embodiment of the present invention being installed onto a base plate 102 of a disc drive. As will be understood from FIGS. 8 and 9, the rotational boss 216 and x-y control boss 212 fit inside the x-y control hole 214 and rotational control hole 220, respectively.

Figure 10:
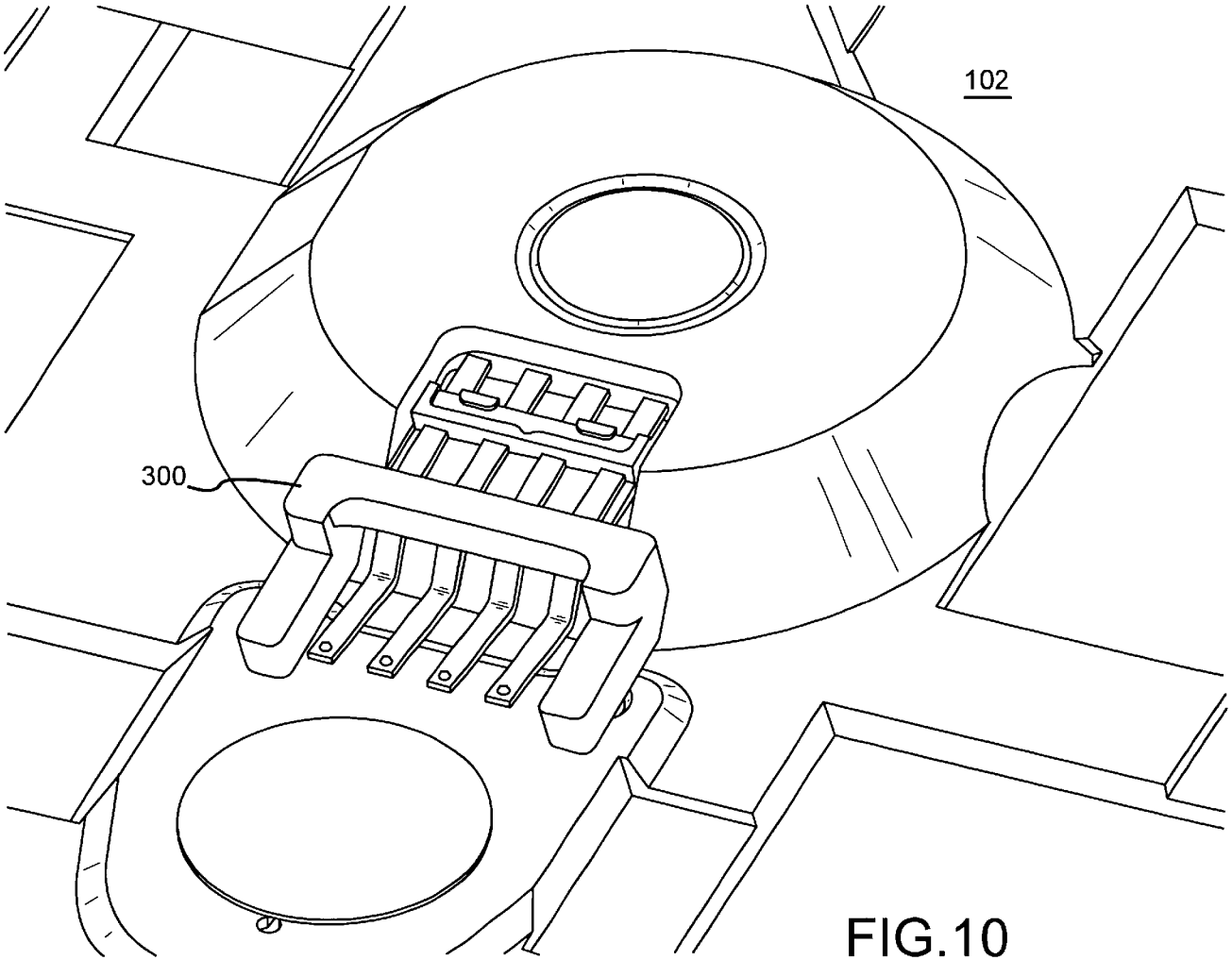
FIG. 10 is an illustration of a spindle motor connector in accordance with an embodiment of the present invention after it is installed onto a base plate of a disc drive.

FIG. 10 illustrates the spindle motor connector 300 after it is installed onto the base plate 102.

It should be understood from the foregoing description that the support legs on the spindle motor connector may be used to restrict how far the PCB can move towards the base plate which provides several functions such as preventing the components near the connector from shorting to the baseplate and preventing the alloy contacts from being overstressed by counteracting the loading on the alloy contacts. Without the support legs, this loading may break the adhesive joint by peeling the spindle motor connector off the baseplate.

An embodiment of the present invention may be used to increase throughput in the manufacturing process by eliminating the need to fix the spindle motor connector while an adhesive cures. An embodiment of the present invention eliminates the need for the costly design, procurement, maintenance, and storage of fixtures that are used to bias prior art spindle motor connectors. It should also be understood that an embodiment of the present invention is self-fixturing by providing x-y location control and rotational control. An embodiment of the present invention is self-fixturing and thus can be assembled in less time than the same quantity of parts assembled with a fixture.

In one embodiment of the invention, the spindle motor connector 200 includes a biasing (self-fixture) feature against a reference edge thus minimizing the manufacturing problems due to rotational errors. The spindle motor connector 300 may use a fixed point at a distance from the x-y locating feature to yield even better rotational control, as a result of the geometry that places this point even further away from the x-y locating feature than the crush rib style associated with connector 200. The spindle motor connector 300 also adds support legs 218 which eliminate the peeling apart of the adhesive joint and prevents over-travel of the PCB that could cause damage to the alloy contacts.

In summary, an embodiment of the present invention may be viewed as a spindle motor connector (such as 200) for connecting a disc drive printed circuit board (PCB) to a spindle motor (such as 106) of a disc drive (such as 100). The connector includes a number of contacts (alloy in some embodiments) (such as 204) for connecting to a number of pads on the PCB. The connector also includes a body portion (such as 202) for mounting the connector to a base plate (such as 102) of the disc drive. The body portion may include a crush rib (such as 206) extending from the body portion and making contact with a wall (such as locating edge 208) of the base plate to restrict rotational movement of the connector. An optional feature of the connector is an x-y control boss extending from the bottom of the body portion. The optional x-y control boss (such as 212) is received by an optional x-y control opening of the base plate so that movement of the connector is restricted in the x-axis and y-axis directions of a two-dimensional plane. The connector may include an optional extending member (such as 210) that restricts loading from the PCB on the contacts. In a preferred embodiment, the contacts are alloy and the body portion is plastic.

Stated another way, an embodiment of the invention may be viewed as a spindle motor connector with a number of contacts and a means for biasing the spindle motor connector to a base plate of a disc drive to prevent rotational movement of the spindle motor connector. The connector may also include an optional means for preventing movement of the spindle motor connector in the x-axis and y-axis directions of a two-dimensional plane, such as an x-y control boss. The connector may also include an optional means for protecting a number of contacts from being damaged by the load from a disc drive printed circuit board. In a preferred embodiment, the means for biasing the spindle motor connector to a base plate of a disc drive to prevent rotational movement of the spindle motor connector is a rotational boss (such as 216). The connector may also include an optional means, such as the extending member 210 or a number of support legs 218, for protecting the contacts from the load exerted by the disk drive PCB.

In another embodiment of the invention, the spindle motor connector (such as 300) is connected to a disc drive printed circuit board (PCB) and a spindle motor of a disc drive and includes a number of contacts (such as 204), a rotational boss (such as 216), an x-y control boss (such as 212) and support legs (such as 218). The rotational boss may be an optional extension from the bottom of the spindle motor connector to restrict rotational movement of the connector. The x-y control boss may be an optional extension from the bottom of the spindle motor connector that restricts movement of the connector in an x-axis direction and a y-axis direction. Optionally, the support legs may extend alongside the contacts at a height slightly less than the contacts so that the contacts may connect to pads on the disc drive PCB so that if the disc drive PCB exerts a load on the contacts the disc drive PCB will contact the support legs preventing damage to the contacts. Optionally, the support legs may counteract the force of the PCB on the connector and prevent the spindle motor connector from being separated from a baseplate of the disc drive.

It will be clear that embodiments of the present invention are well adapted to attain the ends and advantages mentioned as well as those inherent therein. While a presently preferred embodiment has been described for purposes of this disclosure, various changes and modifications may be made which are well within the scope of the present invention. For example, although the contacts have been described above as alloy contacts, the contacts may be made of different types of materials without departing from the present invention. Those skilled in the art will also understand that the present invention may be implemented with different styles of connectors such as a pin and socket style connector, a pin and receptacle connector, etc. Numerous other changes may be made which will readily suggest themselves to those skilled in the art and which are encompassed in the spirit of the invention disclosed and as defined in the appended claims.

What is claimed is:

1. In a disc drive having a disc drive printed circuit board (PCB) fastened to a bottom surface of a base plate and a spindle motor mounted to an upper surface of the base plate of the disc drive wherein the base plate has a recess formed within the baseplate beneath the spindle motor, the recess being defined by a reference wall extending substantially at a right angle to an upper surface of the base plate, a bottom substantially parallel to the upper surface of the base plate and an opposite wall spaced from the reference wall, a spindle motor connector connecting the spindle motor with the PCB comprising:

a plurality of contacts contacting a plurality of pads on the PCB; and an insulative body portion in the recess housing the plurality of contacts, wherein the body portion is has a side wall and an opposite side wall dimensioned such that the opposite side wall is spaced from the opposite wall of the recess when the connector is installed in the recess with the side wall contacting the reference wall, the body portion having a crush rib extending from the opposite side wall of the body portion for making contact with the opposite wall of the recess in the base plate to restrict rotational movement of the connector when the connector is positioned in the recess in the base plate of the disc drive.

2. The connector of claim 1 further comprising an x-y control boss extending from a bottom of the body portion.

3. The connector of claim 2 wherein the x-y control boss is positioned on the bottom of the bottom portion of the connector so as to be received within an x-y control opening in the bottom of the recess in the base plate so that movement of the connector in a direction parallel to the upper surface of the base plate is restricted.

4. The connector of claim 3 wherein the body portion further comprises an extending member protruding from the body portion and positioned on the body portion so as to restrict loading from the PCB on the contacts when the connector is installed in the recess and the PCB is fastened to the base plate of the disc drive.

5. The connector of claim 4 wherein the contacts are alloy and the body portion is plastic.

6. In a disc drive having a base plate, a printed circuit board fastened to the base plate, a spindle motor fastened to the base plate and a recess formed in the base plate beneath the spindle motor between the spindle motor and the printed circuit board, a spindle motor connector comprising:

a connector body sized smaller than the recess permitting rotational movement of the body within the recess;

a plurality of contacts carried in the body; and a means on the body for biasing the spindle motor connector in a predetermined position within the recess in the base plate of the disc drive to prevent rotational movement of the spindle motor connector when the body is mounted in the recess in the base plate of the disc drive.

7. The spindle motor connector of claim 6 wherein the recess in the base plate is defined by a reference wall, a bottom and an opposite wall and the means for biasing the spindle motor connector comprises a crush rib positioned on the body to bias the connector against and between the walls when the connector is positioned within the recess.

8. The spindle motor connector of claim 6 wherein the recess in the base plate is defined by a reference wall, a bottom and an opposite wall and wherein the means for biasing the spindle motor connector comprises a rotational boss projecting from a bottom of the body for engaging a complementary feature in the bottom of the recess when the connector is positioned within the recess.

9. The spindle motor connector of claim 8 further comprising a means on the body for preventing movement of the spindle motor connector in a direction transverse to an axis of rotation of the spindle motor when the connector is positioned within the recess.

10. The spindle motor connector of claim 9 wherein the means for preventing movement of the spindle motor connector in the transverse direction is an x-y control boss projecting from the bottom of the connector for engaging a corresponding feature in the bottom of the recess when the connector is positioned within the recess.

11. The spindle motor connector of claim 10 further comprising a means for protecting the plurality of alloy contacts from an excessive load from the disc drive printed circuit board when the connector is positioned within the recess in the base plate and the printed circuit board is fastened to the base plate.

12. The spindle motor connector of claim 11 wherein the means for protecting the plurality of alloy contacts comprises an extending member extending from the body of the spindle motor connector beneath the alloy contacts.

13. The spindle motor connector of claim 11 wherein the means for protecting the plurality of alloy contacts comprises a plurality of support legs extending alongside the plurality of alloy contacts.

14. A spindle motor connector electrically connecting a printed circuit board (PCB) to a spindle motor in a disc drive, the disc drive having a disc drive base plate supporting the spindle motor on an upper surface thereof and the printed circuit board on a bottom surface thereof, the base plate having a connector recess formed within the base plate beneath the spindle motor to receive the connector, the recess being defined by a reference wall extending substantially at a right angle to an upper surface of the base plate, a bottom substantially parallel to the upper surface of the base plate and an opposite wall spaced from the reference wall, the spindle motor connector comprising:

a plurality of contacts connecting to a plurality of pads on the PCB; and a connector body portion within the recess housing the plurality of contacts, the body portion having a side wall and an opposite side wall dimensioned such that the opposite side wall is spaced from the opposite wall of the recess when the connector is installed in the recess with the side wall contacting the reference wall, the body portion having a crush rib extending from the opposite side wall of the body portion for making contact with the opposite wall of the recess in the base plate to restrict rotational movement of the connector body portion when the connector is positioned in the recess in the base plate.

15. The connector of claim 14 further comprising an x-y control boss protruding from a bottom of the body portion.

16. The connector of claim 15 wherein the x-y control boss is received within an x-y control opening in the bottom of the recess in the base plate so that movement of the connector in a direction parallel to the upper surface of the base plate is restricted.

17. The connector of claim 16 wherein the body portion further comprises an extending member protruding from the body portion and positioned on the body portion so as to restrict loading from the PCB on the contacts when the connector is installed in the recess and the PCB is fastened to the base plate of the disc drive.

* * * * *